United States Patent [19]

Foster

[11] 4,098,421

[45] Jul. 4, 1978

[54] CONTAINER FOR SNUFF OR THE LIKE

[75] Inventor: John A. Foster, Rockford, Ill.

[73] Assignee: J. L. Clark Manufacturing Co., Rockford, Ill.

[21] Appl. No.: 809,560

[22] Filed: Jun. 24, 1977

[51] Int. Cl.[2] ..... B65D 41/18

[52] U.S. Cl. ..... 215/321; 220/306

[58] Field of Search ..... 215/321, 307, 317, 365; 220/306, 214

[56] References Cited

U.S. PATENT DOCUMENTS

| | | | |
|---|---|---|---|
| 3,088,830 | 5/1963 | Graham | 215/365 |
| 3,170,588 | 2/1965 | Lyon | 220/306 |
| 3,362,556 | 1/1968 | Waldrum | 215/321 |
| 4,037,746 | 7/1977 | VerHage | 215/321 |

FOREIGN PATENT DOCUMENTS

| | | | |
|---|---|---|---|
| 1,291,852 | 10/1972 | United Kingdom | 215/354 |

*Primary Examiner*—Herbert F. Ross

*Attorney, Agent, or Firm*—Leydig, Voit, Osann, Mayer & Holt, Ltd.

[57] ABSTRACT

A container for snuff includes a cup-shaped body and a cup-shaped cover both molded of plastic. When the cover is telescoped onto the body, an inwardly projecting rib on the cover snaps past an outwardly projecting rib on the body and then presses against the body to hold the cover releasably on the body while establishing a seal between the cover and the body.

3 Claims, 5 Drawing Figures

CONTAINER FOR SNUFF OR THE LIKE

BACKGROUND OF THE INVENTION

This invention relates to a container and, more particularly, to a container for a tobacco product such as snuff. Heretofore, commercially available snuff containers have almost universally included a cup-shaped circular cover adapted to slip onto a cup-shaped circular body. The cover usually is made of metal while the body usually is made of cardboard. A band-type label is cemented to the outer sides of the cover and the body and extends around the joint between the two.

SUMMARY OF THE INVENTION

The general aim of the present invention is to provide a new and improved snuff container in which both the cover and the body are molded of plastic and are respectively formed with inwardly and outwardly projecting ribs adapted to coact uniquely with one another to hold the cover releasably on the body, the rib on the cover also serving to establish a seal between the cover and the body to enable the snuff to stay fresher for a longer period of time.

A more detailed object is to provide a snuff container having a plastic cover and a plastic body formed with coacting ribs which facilitate molding of the body and which facilitate high speed automatic assembly of the cover with the body after the latter has been filled.

Still another object is to provide a snuff container in which a groove is uniquely defined between the body and the cover to facilitate tearing of the label and removal of the cover.

A further object of the invention is to provide novel upright ribs on the body in order to prevent air from being trapped in the body when the cover is first telescoped onto the body.

These and other objects and advantages of the invention will become more apparent from the following detailed description when taken in conjunction with the accompanying drawings.

DETAILED DESCRIPTION OF THE PREFERRED EMBODIMENT

Figure 1:
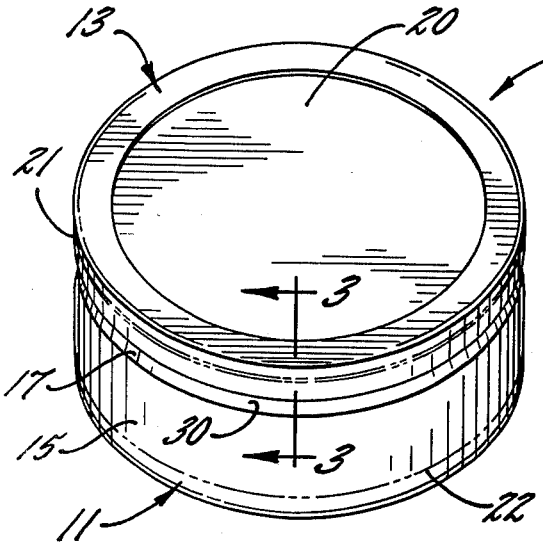
FIG. 1 is a perspective view of a new and improved container incorporating the novel features of the present invention.

As shown in the drawings for purposes of illustration, the invention is embodied in a container 10 comprising a body 11 and a cover 13, the latter being adapted to be telescoped releasably onto the body. The container 10 is particularly suited for use as a package for snuff or for a similar tobacco product.

The container body 11 is cup-shaped and includes a bottom wall 14 and a circular side wall 15 formed integrally with and upstanding from the bottom wall. A circular neck 16 of reduced diameter is located adjacent the upper end of the side wall 15 and is joined integrally to the latter by a short frusto-conical wall section 17.

Figure 2:
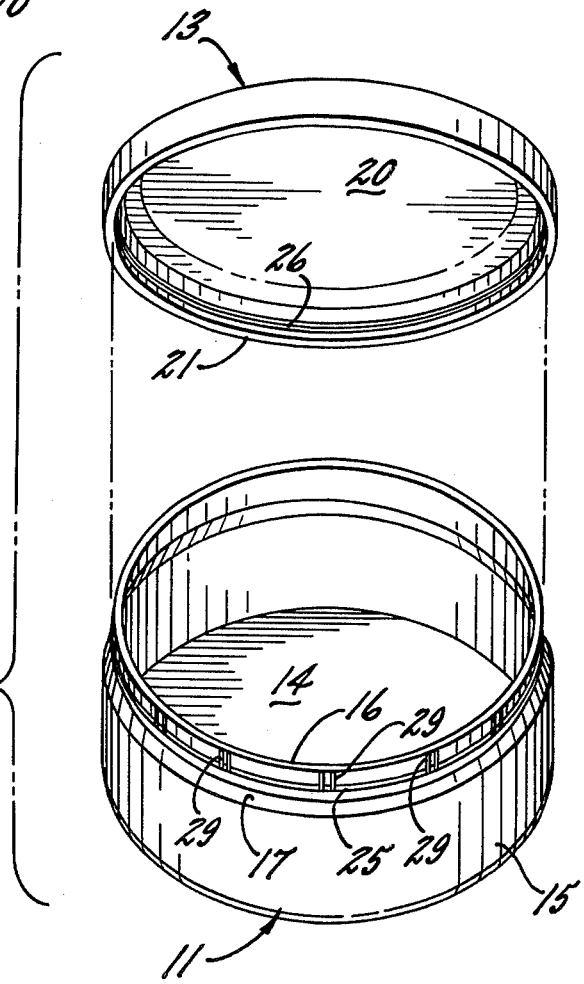
FIG. 2 is an exploded perspective view of the container shown in FIG. 1.
Figure 3:
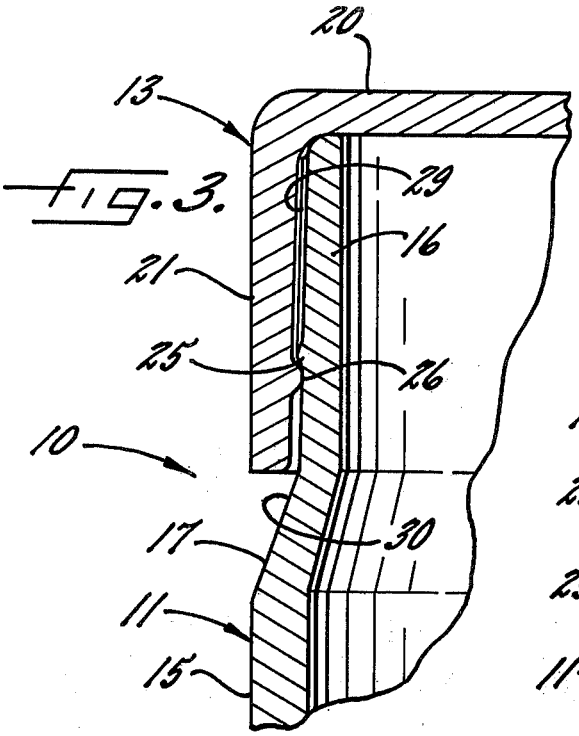
FIG. 3 is an enlarged fragmentary cross-section taken substantially along the line 3—3 of FIG. 1.
Figure 4:
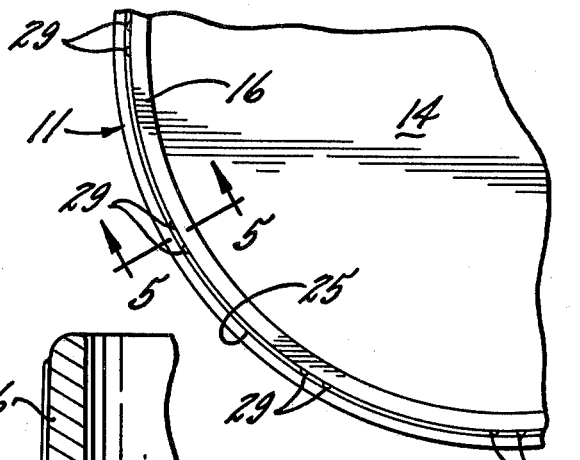
FIG. 4 is an enlarged fragmentary top plan view of the container body.
Figure 5:
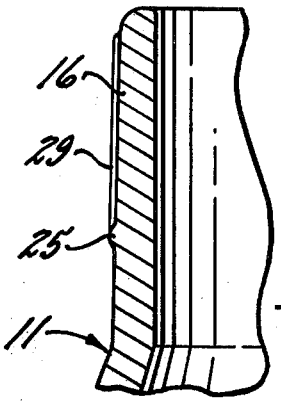
FIG. 5 is an enlarged fragmentary cross-section taken substantially along the line 5—5 of FIG. 4.

As shown in FIG. 2, the cover 13 also is cup-shaped and is appreciably shallower than the body 11. The cover includes a top wall 20 and a circular skirt 21, the latter being formed integrally with and depending from the top wall. The skirt 21 is of sufficient diameter to telescope over the neck 16 of the body 11 and is of such thickness that its outer side is disposed substantially flush with the outer side of the side wall 15 of the body when the cover is placed on the body. Thus, a band-type label 22 (FIG. 1) may be placed around and cemented to the wall 15 and the skirt 21 and will close the joint therebetween until such time as the container is initially opened. In the closed position of the cover, the top wall 20 thereof abuts the upper end of the neck 16 while the lower edge of the skirt 21 terminates at the upper end of the frusto-conical wall section 17.

In accordance with the invention, both the body 11 and the cover 13 of the snuff container 10 are molded of plastic and the two are formed with ribs 25 and 26, respectively, which coact in a novel manner to hold the cover releasably on the body and to establish a seal between the cover and the body. By virtue of ribs being formed on both the cover and the body, molding of the body and automatic assembly of the body with the cover are easier to accomplish than is the case when the cover and the body are held releasably together by a rib-and -groove connection.

More specifically, the rib 25 on the body 11 is formed on the neck 16 just short of midway between the lower and upper ends of the neck. The rib 25 projects outwardly from the outer side of the neck and extends continuously around the circumference thereof. The rib 25 is curved on a radius of about 0.015 inch and has a thickness of only about 0.002 inch. Being very small, the rib 25 may be molded by the stripper of a die set having a floating core and will not be wiped away when the die set is opened and the body is ejected.

The rib 26 on the cover 13 projects inwardly from the inner side of the skirt 21 and extends around the full circumference of the skirt. When the cover is telescoped onto the body 11, the rib 26 snaps resiliently past the rib 25 and then engages the underside of the latter rib with a detent action to hold the cover on the body. The detent action effected between the two ribs prevents the cover from sliding freely off of the body but enables the cover to be pulled easily from the body, the rib 26 snapping reversely past the rib 25 when the cover is removed.

When the cover 13 is in its closed position, the rib 26 engages the outer side of the neck 16 with an interference fit to establish a seal between the cover and the body 11. In the present instance, the relaxed inside diameter of the rib 26 is approximately 0.01 inch smaller than the relaxed outer diameter of that portion of the neck 16 located immediately below the rib. Accordingly, the rib presses resiliently against the neck to seal the container 10 and help maintain the contents thereof in a fresh condition.

When the cover 13 is placed on the body 11 by high speed automatic packaging equipment, the cover is held in an inclined position and the body is moved in a radial direction until the leading side of the neck 16 encounters the skirt 21. Thereafter, the cover is slapped downwardly and telescoped onto the body. Because the body and the cover are formed with the coacting ribs 25 and 26 rather than one member being formed with a rib and the other a groove, automatic assembly of the cover with the body may be effectively accomplished in the above-described manner even when there is a relatively tight interference fit between the cover and the body.

Further in keeping with the invention, several pairs of upright ribs 29 (FIGS. 2 to 5) are formed integrally with and are spaced angularly around the outer side of the neck 16. The upright ribs 29 are located above the outwardly projecting rib 25, extend downwardly from the upper end portion of the neck to the upper side of the rib 25 and are considerably thinner than the rib 25. After the body 11 has been filled and as the cover 13 is first telescoped downwardly onto the body, the upright ribs 29 keep the inwardly projecting rib 26 on the cover from contacting the outer side of the upper end portion of the neck and thus hold the rib 26 in outwardly spaced relation from the upper end portion of the neck. As a result, air in the headspace of the body may escape outwardly between the cover and the body as the cover is telescoped downwardly onto the body. Accordingly, such air is vented from the body rather than being pressurized and thus the air is not effective to pop the cover back off of the body. Once the rib 26 snaps past the rib 25, the container 10 is sealed in the manner described above.

Advantageously, the frusto-conical wall section 17 defines an annular groove 30 (FIG. 3) around the outer side of the container 10 and facilitates insertion of a thumb nail between the body 11 and the cover 13 for the purpose of cutting the label 22 around the joint between the cover and the body. The groove also enables one to use his thumb nail to lift the cover off of the body against the holding action provided by the ribs 25 and 26.

I claim:

1. A snuff container comprising a plastic cup-shaped body of circular cross-section, said body having a bottom wall and having a circular side wall molded integrally with and upstanding from said bottom wall, a circular neck of reduced diameter formed integrally with and projecting upwardly from the upper end of said side wall, said container further comprising a plastic cup-shaped cover of circular cross-section, said cover having a top wall and having a circular skirt molded integrally with and depending from said top wall, said skirt being sized to telescope downwardly over the neck of said body with the outer side of said skirt disposed substantially flush with the outer side of the side wall of the body, an outwardly projecting rib formed integrally with and extending circumferentially around the outer side of said neck intermediate the upper and lower ends thereof, and a continuous inwardly projecting rib formed integrally with and extending circumferentially around the inner side of said skirt and sized to snap past said outwardly projecting rib and engage and seal resiliently against a continuous circumferentially extending and radially facing portion of the outer side of said neck with an interference fit when said cover is telescoped downwardly over said body whereby said inwardly projecting rib establishes a seal between said cover and said body and engages said outwardly projecting rib to hold said cover releasably on said body, said interference fit being established by virtue of the relaxed inside diameter of said inwardly projecting rib being less than the relaxed outer diameter of that portion of said neck engaged by said inwardly projecting rib, said container further including several upright ribs formed integrally with and spaced angularly around the outer side of said neck, said upright ribs being located above said outwardly projecting rib and holding said inwardly projecting rib out of contact with the outer side of said neck as said cover is initially telescoped downwardly over said neck thereby to allow air to escape from said body during such initial telescoping.

2. A snuff container as defined in claim 1 in which a label extends around the joint between said cover and said body and is secured to both the cover and the body, there being a circumferential groove defined in said body just below the lower edge of said skirt to facilitate tearing of said label.

3. A snuff container as defined in claim 2 in which said side wall is tapered upwardly and inwardly adjacent the lower end of said neck and is frusto-conical in shape so as to define said groove.

* * * * *